US007331746B2

(12) United States Patent
Wright et al.

(10) Patent No.: US 7,331,746 B2
(45) Date of Patent: Feb. 19, 2008

(54) APPARATUS FOR HANDLING AND RACKING PIPES

(75) Inventors: Monte Neil Wright, Calgary (CA); William John Stroshein, Calgary (CA); David Louis Richard, Calgary (CA); Andrew Scott Banister, Calgary (CA)

(73) Assignee: Iron Derrickman Ltd., Calgary (CA)

( * ) Notice: Subject to any disclaimer, the term of this patent is extended or adjusted under 35 U.S.C. 154(b) by 353 days.

(21) Appl. No.: 10/997,930

(22) Filed: Nov. 29, 2004

(65) Prior Publication Data

US 2006/0113073 A1 Jun. 1, 2006

(51) Int. Cl.
*E21B 19/00* (2006.01)
*A01G 23/02* (2006.01)

(52) U.S. Cl. ..... 414/22.65; 414/746.3; 414/23

(58) Field of Classification Search ..... 414/22.63, 414/22.65, 22.68, 22.71, 23, 746.3; 175/52, 175/85; 166/77.51; 294/88, 102.2; 405/154.1; 81/57.35; 173/4; 901/1, 14, 15, 21, 22, 901/25, 37, 39
See application file for complete search history.

(56) References Cited

U.S. PATENT DOCUMENTS 2,295,720 A * 9/1942 Dietzmann et al. ..... 166/77.51
4,013,178 A 3/1977 Brown et al.
4,067,369 A * 1/1978 Harmon ..... 144/34.1
4,077,525 A 3/1978 Callegari et al.
4,113,033 A * 9/1978 Lindblad ..... 173/1
4,117,941 A 10/1978 McCleskey, Jr. et al.
4,212,577 A * 7/1980 Swanson ..... 414/23
4,274,778 A 6/1981 Putnam et al.
4,531,875 A 7/1985 Krueger
4,621,974 A 11/1986 Krueger
4,765,401 A * 8/1988 Boyadjieff ..... 166/77.53
2001/0025727 A1* 10/2001 Byrt et al. ..... 175/7
2002/0157870 A1* 10/2002 Bischel et al. ..... 175/52

FOREIGN PATENT DOCUMENTS

WO WO 0123701 A1 * 4/2001

* cited by examiner

*Primary Examiner*—Saul Rodriguez
*Assistant Examiner*—Gregory W Adams
(74) *Attorney, Agent, or Firm*—Anthony C. Edwards

(57) ABSTRACT

An apparatus for handling pipes in a derrick and racking the pipes on a pipe racking assembly mounted on the derrick is provided to improve the stability of transferring pipes during a round trip operation. The apparatus includes a rotatable gate assembly mounted on the pipe racking assembly. The rotatable gate assembly includes a collar rotatably mounted to a first end of a shaft and an arm pivotably and rotatably mounted on a second end of the shaft. The collar defines a gate for securing an upper portion of the pipe stand. A first securing means mounted to a second end of the arm secures the mid-portion of the pipe stand and a second securing means mounted to the first securing means secures the lower portion of the pipe stand. After the arm secures the pipe stand from the derrick, a drive mechanism mounted to the shaft rotates the rotatable gate assembly such that the arm may rack the pipe on the pipe racking assembly.

2 Claims, 8 Drawing Sheets

APPARATUS FOR HANDLING AND RACKING PIPES

FIELD OF THE INVENTION

This invention relates to the field of equipment used in the drilling industry, and more particularly, it relates to an apparatus for manipulating and racking pipes in a drilling derrick.

BACKGROUND OF THE INVENTION

In drilling operations, the derrick is the structure designed to support and manipulate the drill string in and out of the well bore. The drill string is a series of drill pipe segments detachably connected together. Typically, the drill pipe segments are coupled together to form a pipe stand of a predetermined or standard length and the pipe stands are then coupled together to form the drill string.

A drill collar and a drill bit are attached to a drill end of the drill string. The drill collar is a heavier pipe having a larger diameter which fits around the drill pipe and places weight on the drill bit such that the downward force from the weight of the drill string, drill collar, and other drilling equipment on the drill bit assists in the drilling process. As the drill bit and drill string rotate and penetrate into the well bore, additional lengths of pipe stands may be connected to the coupling end of the drill string. Each pipe stand is typically thirty to forty five feet in length for larger drilling operations and between fifteen and twenty feet for smaller operations.

Because the drill bit has to be changed after a few days or even a few hours, depending on the hardness of the matter being drilled through, the drill string must be raised and lowered frequently. This involves withdrawing the drill string from the well bore by conventional hoisting means such as a winch mounted to the derrick, uncoupling the pipe stands of the drill string using a power wrench, and stacking the pipe stands in a conventional pipe storage or racking assembly such as a finger board assembly. In larger operations, the drill string can weigh several hundred tonnes and requires an extremely powerful motor housed in the derrick to withdraw the drill string from the well bore. Typically, electric or hydraulic pipe handling systems transport pipe stands between the well bore and the derrick to and the storage assembly. After replacing the bit, the pipe stands are removed from the storage assembly by the pipe handling system and transported back to the drill string where the pipe stands are re-coupled with the drill string and lowered back down the well bore to recommence drilling. Known as a "round trip", this operation can take up to ten hours or more, depending on the depth of the well.

There are several devices and apparatus known in the art designed to improve the efficiency of the round trip operation. For example, U.S. Pat. No. 4,621,974 to Krueger, issued Nov. 11, 1986, provides an automated pipe equipment system for automatically removing pipe stands from and adding pipe stands to a drill string by using sensing means such as transducers to indicate to a programmable controller whether a pipe joint has been grasped by a racking arm. This system increases the efficiency of the round trip operation by reducing the manual labour typically required to facilitate various steps in the operation, such as ensuring that the racking arm has securely grasped the pipe stand. Furthermore, U.S. Pat. No. 4,117,941 to McCleskey Jr. et al., issued Oct. 3, 1978, provides a device which rapidly handles and vertically racks riser pipes and drill pipes in the drilling derrick. Manipulators effect the desired displacement of the pipes such that the lower ends of the pipes may rest on a set back platform on the drill floor and the upper ends of the pipes may be secured in a finger board. In addition, U.S. Pat. No. 4,013,178 to Brown et al., issued Mar. 22, 1977, provides a pipe racker wherein a manoeuvrable arm mounted on the derrick may grip the pipe joint anywhere along its length, lift the pipe, and move the pipe to another location without the need of a cable support. The vertical, horizontal and telescoping of the manoeuvrable arm provides the racker with three orthogonal degrees of freedom While the prior art provides devices for handling pipe stands in a more efficient manner, they do not provide a solution to address the instability associated with manipulating and transporting pipe stands that may exceed thirty feet in length and several hundred tonnes in weight. For example, in the Krueger patent, a clamp engages only an upper portion of the pipe to effect vertical and rotational movement, leaving the mid-portion and lower portion of the pipe vulnerable to undesired swaying movement which may affect the racking rate. Furthermore, the repeated use of clamps and other similar securing means causes scarring of the pipe stands which eventually causes weakening and breakage of the pipe stands. Conventional securing means used in the art also fails to provide proper or adequate support of the weight of the pipe stand. Therefore, an unaddressed need exists in the industry to provide an apparatus for handling pipes in a stable and efficient manner to deal with deficiencies and inadequacies in the prior art.

SUMMARY OF THE INVENTION

In accordance with the present invention, there is provided an apparatus for handling pipes in a drilling derrick wherein the apparatus stabilizes and supports the pipe stand such that unwanted movement of the pipe stand, which affects the rate of racking, may be reduced, thereby increasing racking efficiency.

In accordance with the present invention, there is provided an apparatus for handling pipes in a drilling derrick and racking the pipes on a pipe racking assembly mounted to the derrick, the apparatus comprising a rotatable gate assembly mounted to the pipe racking assembly. The rotatable gate assembly includes a substantially U-shaped collar and an arm. The collar defines a gate opening to receive and secure an upper portion of a pipe stand and the collar is rotatably mounted to a first end of a shaft. The first end of the arm is pivotably and rotatably mounted to a second end of the shaft and a releaseable pipe mount is mounted to the second end of the arm to engage a predetermined portion of the pipe stand. The releseable pipe mount comprises a first securing means which engages a mid-portion of the pipe stand and a second securing means mounted to the first securing means such that the second securing means may securely engage a lower portion of the pipe stand. The first securing means and the second securing means provides support and stability to the pipe stand when the pipe stand engages the first and the second securing means.

The first securing means may be a magnetic guide extending vertically in parallel to the pipe stand such that the magnetic guide may engage a predetermined length of the mid-portion of the pipe stand to prevent movement of the pipe stand. The second securing means may be a support member attached to a lower end of the magnetic guide such that the support member may receive the pipe stand to support the weight of the pipe stand and prevent movement of the lower portion of the pipe stand. The support member is configured to engage and mate with a tool joint on the pipe stand. The apparatus further comprises a first actuator configured to elevate the first and the second securing means such that the pipe securely engages the first and the second securing means and may be vertically raised for transport between the derrick and the pipe racking assembly. When the first actuator elevates the first and the second securing means, the pipe stand slides vertically downwards until the tool joint engages and mates with the second securing means.

In another embodiment of the invention, the arm is operable by a second actuator such that the arm may displace between a vertical position substantially parallel to the pipe stand and an angled position. The arm may displace between the vertical position and the angled position such that the arm may securely engage the first and the second securing means to the pipe stand. The arm may also displace between the vertical position and the angled position such that the arm may transfer the pipe stand securely engaged to the first and said second securing means to the pipe racking assembly. When the arm retracts to the vertical position after the first and said second securing means securely engages the pipe stand, the collar receives the upper portion of the pipe stand in the gate opening such that the gate opening may prevent movement of the upper portion of the pipe stand.

A drive mechanism is mounted to the shaft to rotate the rotatable gate assembly between a pipe engaging position, wherein the rotatable gate assembly is in operable communication with the derrick, and a pipe racking position, wherein the rotatable gate assembly is in operable communication with the pipe racking assembly. The pipe racking assembly comprises a frame and a plurality of support members wherein each of the support members are attached to the frame at a first end only such that a central gap is defined between the support members. The support members capture and retain the pipe when the arm racks the pipe between the support members.

BRIEF DESCRIPTION OF THE DRAWINGS

These and other features of the invention will become more apparent from the following description in which reference is made to the appended drawings wherein.

DETAILED DESCRIPTION OF EMBODIMENTS OF THE INVENTION

Figure 1:
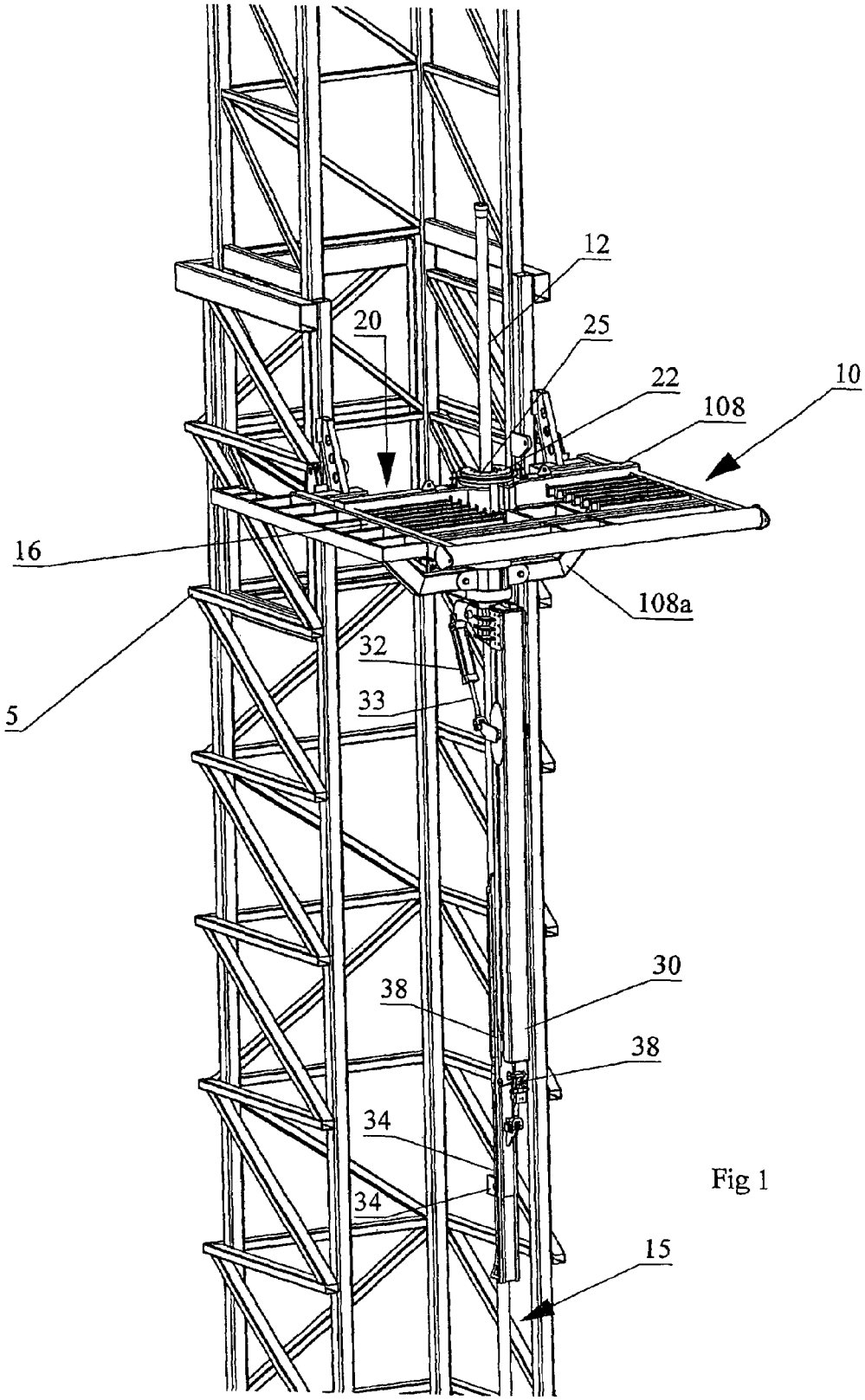
FIG. 1 is a side perspective view of the apparatus for handling pipes.

With reference to FIGS. 1 to 5 wherein similar characters of reference denote corresponding parts in each view, the apparatus for handling pipes according to the present invention includes a derrick 5, a pipe racking assembly 10 mounted to derrick 5, and a rotatable gate assembly 20 mounted to pipe racking assembly 10. In an embodiment of the present invention, the apparatus for handling pipes is configured to handle and rack a plurality of pipe stands 12 which are detachably coupled together to form a drill string 15. Pipe stands 12 are formed by coupling a plurality of pipe joints together. The ends of each pipe joint are flared such that at the point of coupling between pipe joints and pipe stands 12, an annular flange known in the art as a tool joint 14 is formed.

In an embodiment of the invention, pipe racking assembly 10 is generally rectangular in shape and horizontally disposed. Pipe racking assembly 10 is mounted to a mid-portion of derrick 5 such that pipe racking assembly 10 extends outwards and away from derrick 5. Pipe racking assembly 10 includes a frame 16 and a plurality of transversely disposed support members 18 coupled to frame 16 such that each support member 18 attaches to frame 16 at a first end only, thereby defining a central gap 17 between support members 18. In an embodiment of the invention, rotatable gate assembly 20 is mounted to frame 16 such that rotatable gate assembly is positioned in gap 17 so that pipe stand 12 may travel along gap 17 towards support members 18. To rack pipe stand 12, pipe stand 12 is positioned in between support members 18 such that the weight of pipe stand 12 rests on one of the support members 18 and the base of the pipe stand rests on the ground.

Rotatable gate assembly 20 includes a collar 22 rotatably mounted on a first end of a shaft 24 such that shaft 24 journals centrally through collar 22. Preferably, collar 22 is substantially U-shaped and defines a recess or a gate opening 25 for receiving and engaging pipe stand 12. Gate opening 25 may provide additional stability to pipe stand 12, especially to an upper portion of pipe stand 12 when pipe stand 12 is received within gate opening 25 while pipe stand 12 is being transported to pipe racking assembly 10, described below. Collar 22 may be rotated about shaft 24 by way of a conventional drive mechanism 28 mounted to shaft 24. The rotation of collar 22 from a pipe engaging position wherein rotatable gate assembly 20 faces derrick 5, to a pipe racking position wherein rotatable gate assembly 20 faces pipe racking assembly 10, enables the transport of pipe stand 12 away from derrick 5 for racking in between support members 18 of pipe racking assembly 10.

Rotatable gate assembly 20 further includes an arm 30 having a first end and a second end. Preferably, arm 30 is fixed in length, although, depending on the drilling operation although arm 30 may be extendable. The first end of arm 30 may be pivotably mounted on a second end of shaft 24 by way of a pivot pin. In an embodiment of the invention, arm 30 is also rotatably mounted on shaft 24 such that drive mechanism 28 may rotate arm 30 from the pipe engaging position after arm 30 securely engages pipe stand 12 in derrick 5 and into the pipe racking position to transfer pipe stand 12 to pipe racking assembly 10 to position pipe stand 12 in between support members 18. In the pipe engaging position, arm 30 is operable by an actuator 32 to move arm 30 in direction A towards pipe stand 12. Actuator 32 may be a pneumatically or a hydraulically operated cylinder and piston unit. In an embodiment of the invention, actuator 32 is attached to a lever mounted to shaft 24 at a first end and operably coupled to arm 30 at a second end such that extension of piston 33 causes arm 30 to displace from a vertical position parallel to pipe stand 12 to an angled position to engage pipe stand 12 when in the pipe engaging position. When rotated in the pipe racking position, extension of piston 33 causes arm 30 to displace from a vertical position parallel to pipe stand 12 to an angled position to position pipe stand 12 in between support members 18. Refraction of piston 33 causes extendable arm to displace from the angled position back to the vertical position.

A first securing means such as a magnetic guide 34 is attached to the second end of arm 30 such that magnetic guide 34 may assist in directing arm 30 towards pipe stand 12 to engage pipe stand 12 to magnetic guide 34 and therefore to arm 30. Advantageously, magnetic guide 34 extends vertically along the length of pipe stand 12 and generally conforms to the shape of pipe stand 12 such that magnetic guide 34 may engage a larger surface area of pipe stand 12 compared to the securing means used in the prior art. Preferably, magnetic guide 34 extends between one quarter to one third the length of pipe stand 12 and engages onto pipe stand 12 without causing damage to pipe stand 12. Preferably, magnetic guide 34 engages a mid-portion of pipe joint 12 such that magnetic guide 34 may provide greater stability and prevent pipe stand 12 from swaying when pipe stand 12 is uncoupled from drill string 15.

In another embodiment of the invention, a second securing means such as a support member 36 may also be provided to assist magnetic guide 34 in securely engaging pipe stand 12. Support member 36 is configured to receive pipe stand 12 and frictionally engage tool joint 14 such that support member 36 may support the weight of pipe stand 12. In an embodiment of the invention, the interior surface of support member 36 defines a recess that complements the size and shape of tool joint 14 such that when tool joint 14 slides into the recess, support member 36 securely engages tool joint 14 and pipe stand 12 such that support member 36 may support the weight of pipe stand 12. Preferably, support member 36 is attached to a lower end of magnetic guide 34 such that support member 36 may provide additional stability to a lower portion of pipe stand 12.

After magnetic guide 34 engages pipe stand 12 and support member 36 receives pipe stand 12, an actuator 38 elevates magnetic guide 34 and support member 36 such that pipe stand 12 may be vertically lifted away from the drill string. Because the magnetic force of magnetic guide 34 may not be sufficient to entirely support the weight of pipe stand 12, as actuator 38 elevates magnetic guide 34, support member 36 and pipe stand 12, pipe stand 12 may gradually slide vertically downwards until tool joint 14 is received by and engages support member 36 such that support member 36 may securely engage and support the weight of pipe stand 12. Actuator 38 may be a pneumatically or a hydraulically operated cylinder and piston unit. In an embodiment of the invention, a first end of actuator 38 is mounted to the second end of arm 30 and a second end of actuator 38 is operably mounted to magnetic guide 34 such that extension of piston 40 causes magnetic guide 34, support member 36 and pipe stand 12 to elevate. Retraction of piston 40 causes magnetic guide 34, support member 36 and pipe stand 12 to lower.

In operation, after a pipe elevator or any other similar hoisting system raises drill string 15 to a predetermined height, actuator 32 causes arm 30 to pivot about the second end of shaft 24 and extend in direction A towards drill string 15 suspended in the derrick. As arm 30 extends from the vertical position to the angled position towards drill string 15, pipe stand 12 is uncoupled from drill string 15 by conventional detaching means, such as a spinning wrench or power torque wrench. As arm 30 moves towards pipe stand 12, magnetic guide 34 assists in directing arm 30 towards pipe stand 12 such that magnetic guide 34 may engage pipe stand 12. Preferably, magnetic guide 34 engages a mid-portion of pipe stand 12 to stabilize pipe stand 12 and prevent pipe stand 12 from swaying. Furthermore, support member 36 engages tool joint 14 of a lower portion of pipe stand 12 to support the weight of pipe stand 12 and provide stability to the lower portion of pipe stand 12. After magnetic guide 34 engages and support member 36 receives pipe stand 12, actuator 38 elevates magnetic guide 34 and support member 36 such that the lowermost portion of pipe joint 12 previously coupled to drill string 15 may be elevated and transported vertically away from drill string 15 and the well bore.

To rack pipe stand 12 on pipe racking assembly 10, rotatable gate assembly 20 must rotate away from derrick 5 along with pipe stand 12 such that arm 30 may transfer pipe stand 12 to engage support members 18. To that end, actuator 32 causes arm 30 to retract from the angled position to the vertical position, such that the upper portion of pipe stand 12 may be received into gate opening 25 to further stabilize pipe stand 12. Drive mechanism 28 then rotates collar 22 and arm 30 from the pipe engaging position facing derrick 5 to a pipe racking position towards pipe racking assembly 10 such that pipe stand 12 may be positioned in between support members 18. Actuator 32 then causes arm 30 and pipe stand 12 to extend and travel along gap 17 such that pipe stand 12 may be secured in a predetermined location between support members 18. Actuator 38 lowers magnetic guide 34, support member 36, and pipe stand 12 such that pipe stand 12 may lean against support members 18.

Figure 2:
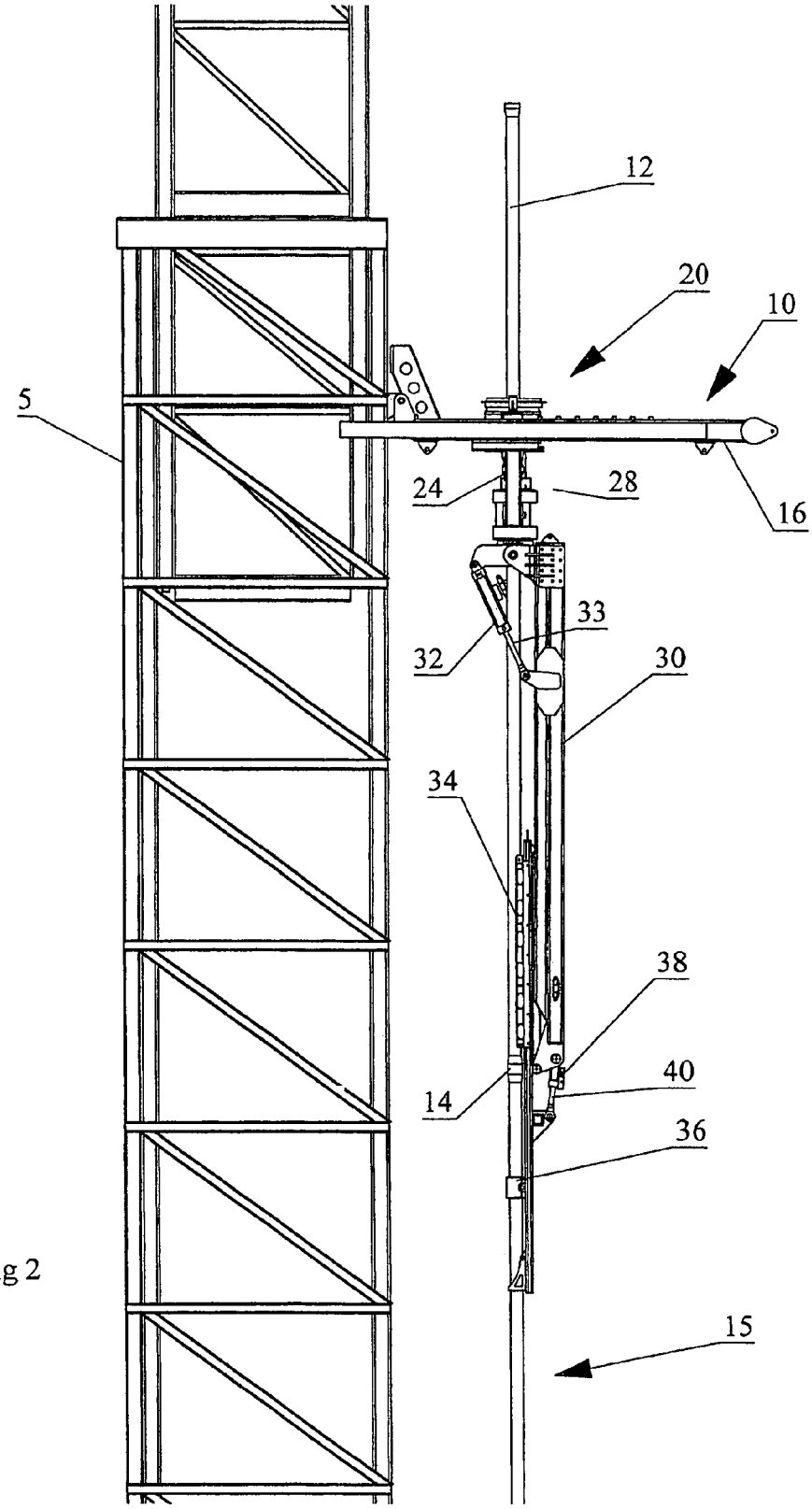
FIG. 2 is a side view of the apparatus for handling pipes as shown in FIG. 1.
Figure 2A:
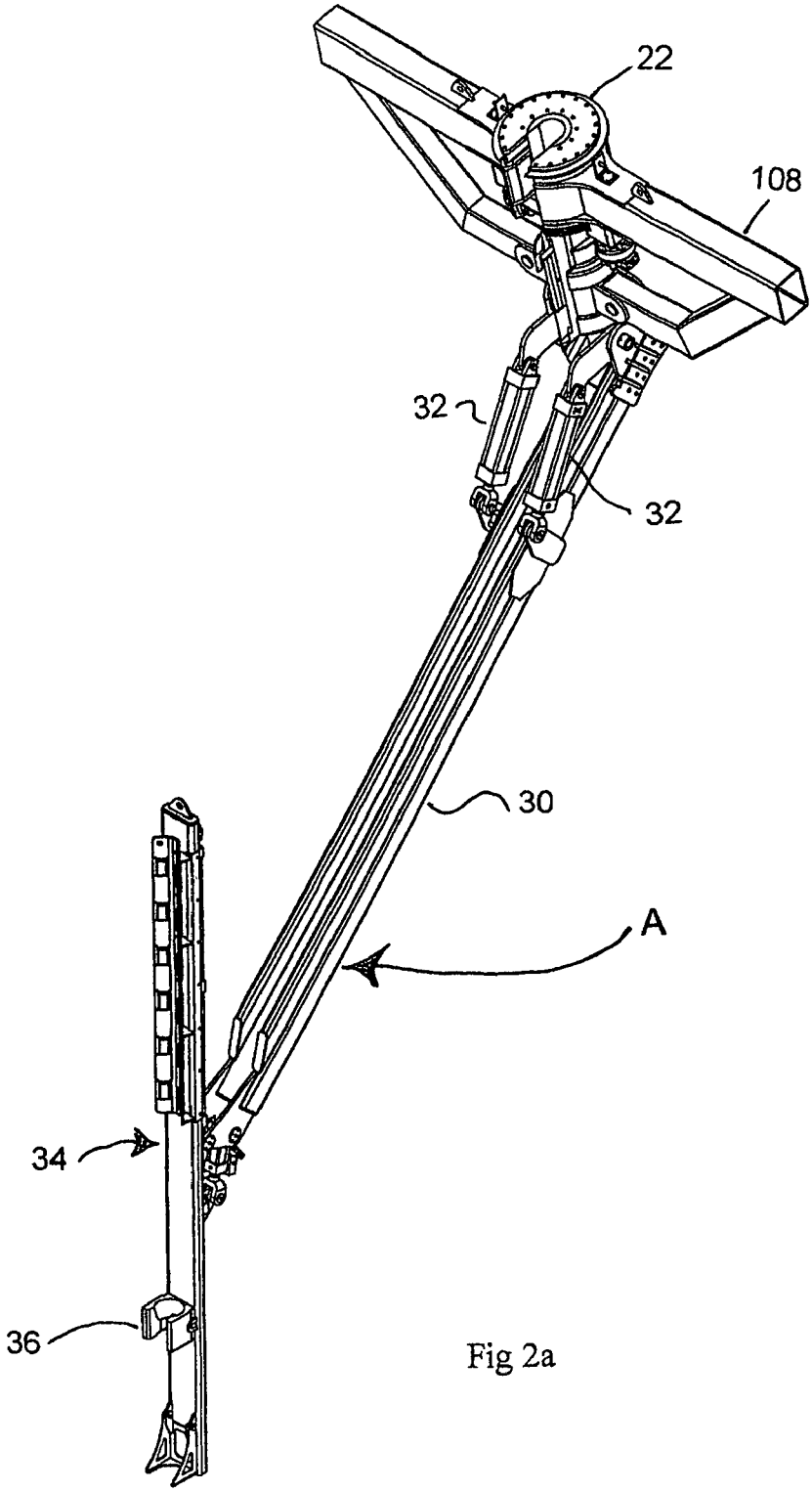
FIG. 2*a* is a side perspective view of the pipe racking assembly and the rotatable gate assembly of the apparatus for handling pipes as shown in FIG. 1.
Figure 2C:
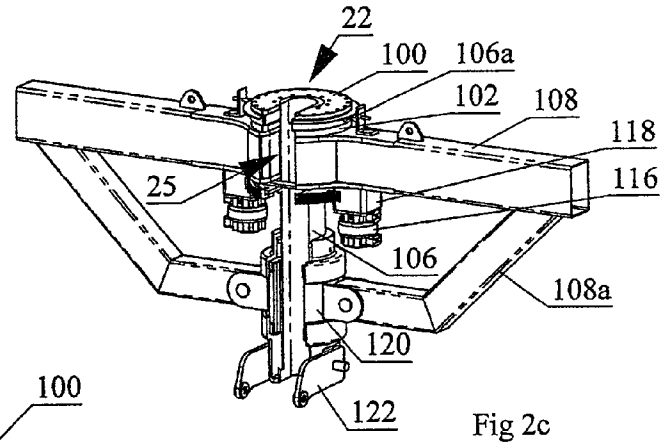
FIG. 2*c* is an assembled perspective of FIG. 2*b*.
Figure 2B:
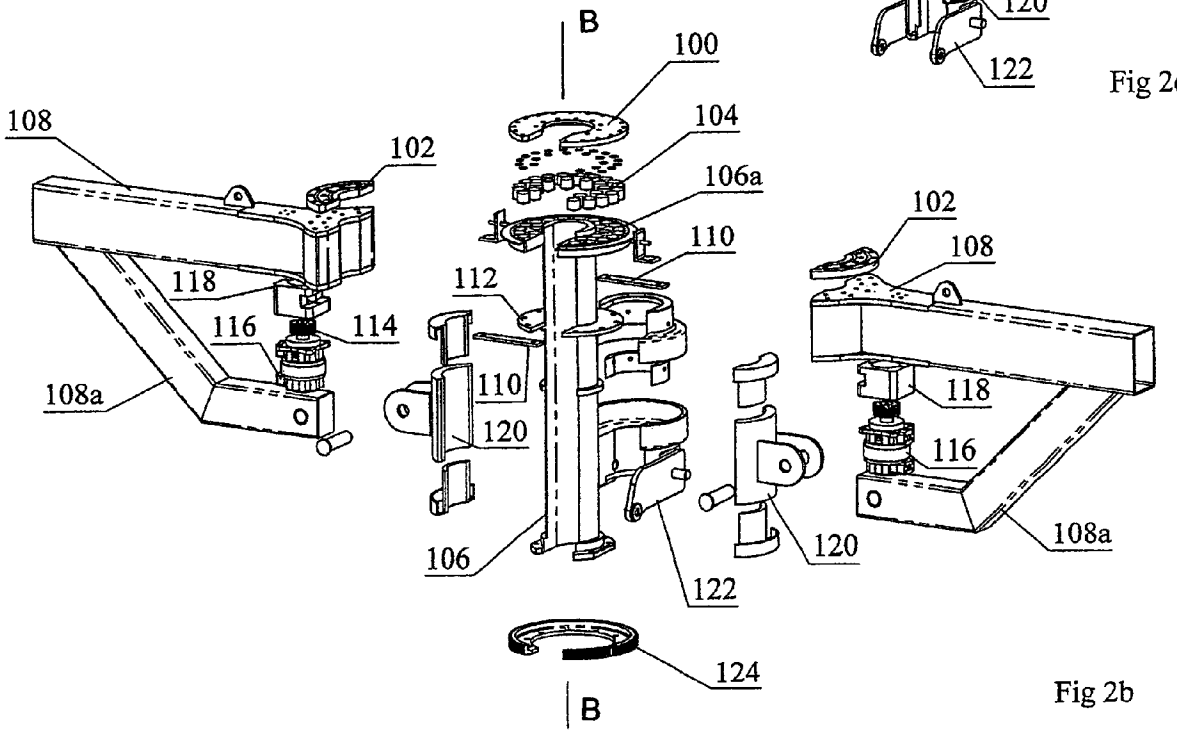
FIG. 2*b* is an exploded view of the rotatable gate assembly as shown in FIG. 2*a;*
Figure 2D:
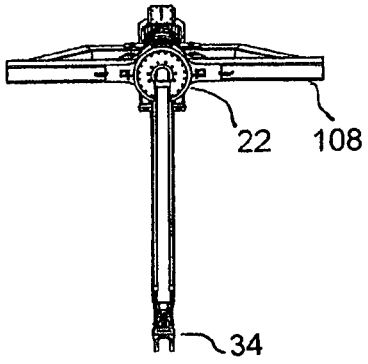
FIG. 2*d* is a plan view of FIG. 2*a*.
Figure 2E:
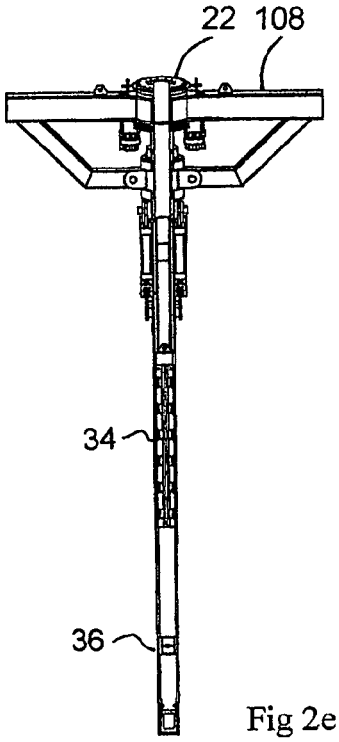
FIG. 2*e* is a front view of FIG. 2*a*.
Figure 2F:
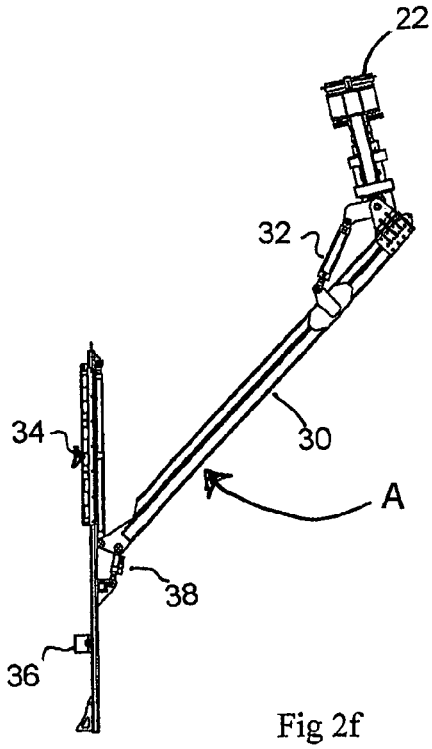
FIG. 2*f* is a side view of FIG. 2*a*.
Figure 3:
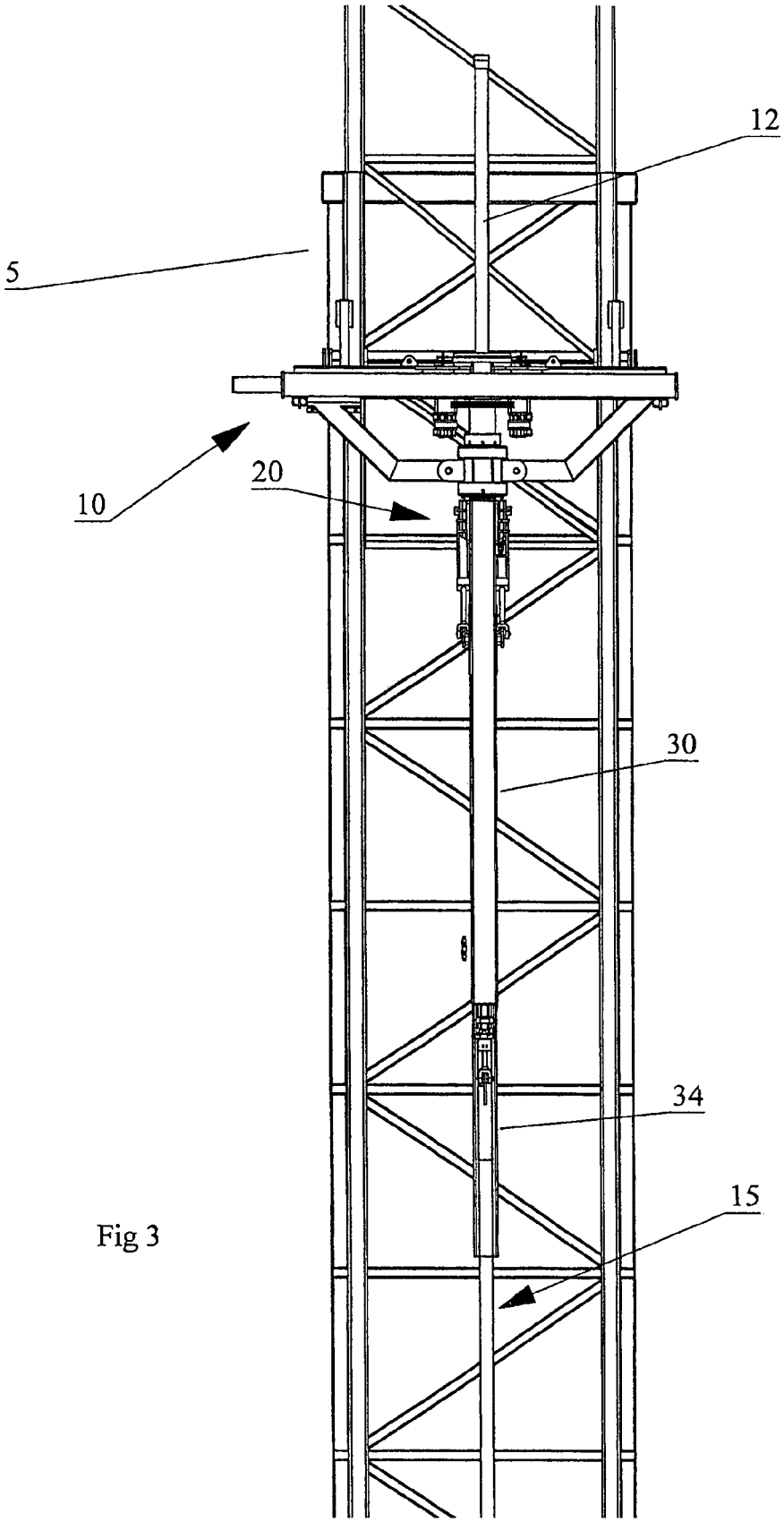
FIG. 3 is a front view of the apparatus for handling pipes as shown in FIG. 1.
Figure 4:
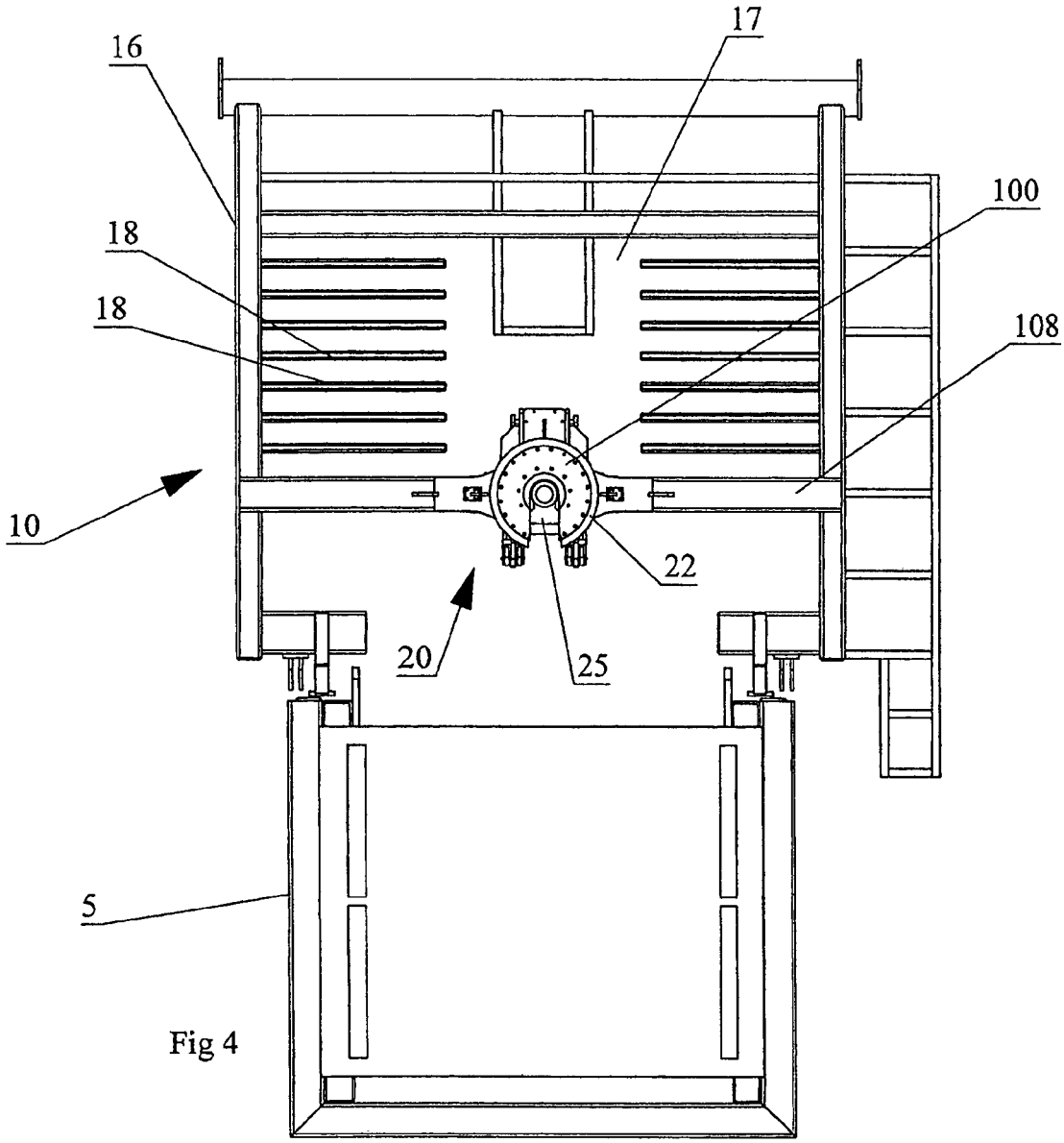
FIG. 4 is a plan view of the apparatus for handling pipes as shown in FIG. 1.
Figure 5:
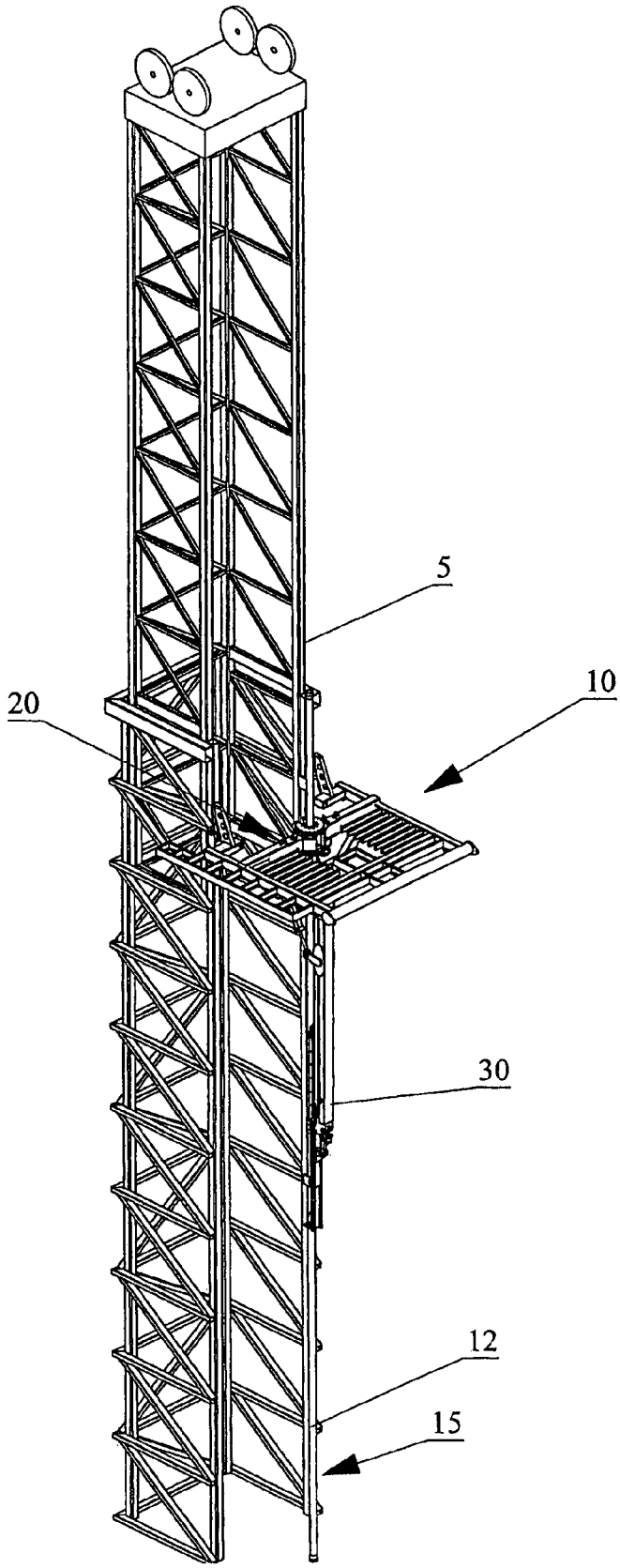
FIG. 5 is a side perspective view of the apparatus for handling pipes mounted on a derrick.

As seen in the perspective exploded view of FIG. 2*b*, and the assembled perspective view of FIG. 2*c* upper and lower bearing covers 100 and 102 sandwich therebetween bearings 104 within the upper apertured flange 106*a* of rotator tube 106. Rotator tube 106 is rotatably clamped between fixed rotator arms 108 rigidly mounted to the platform. Rotator tie bars 110 are pinned to a lower flange 112 which is rigidly mounted to rotator tube 106. The opposite ends of tie bars 110 may be pinned to an actuating mechanism. Driver gears 114 are driven by hydraulic motors 116. Hydraulic motors 116 are mounted to so as to depend from hydraulic motor housings 118 in a column between rotor arms 108 and lower support arms 108*a*. Rotor tube 106 is further rotatably supported between an opposed facing pair of clamping members 120 each of which are mounted to the corresponding opposed facing distal ends of arms 108*a*. The lower end of clamping members 120 are supported on a horseshoe shaped mounting bracket 122. Drive gears 114 engage bull gear 124 which is mounted circumferentially around lower flange 112 so that actuation of hydraulic motors 116 rotates rotator tube about its axis of rotation B.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for handling pipes in a derrick and racking the pipes on a pipe racking assembly mounted on the derrick, the apparatus comprising:

a rotatable gate assembly mounted to the pipe racking assembly, said rotatable gate assembly having a substantially U-shaped collar and an arm, said collar defining a gate opening to receive and secure an upper portion of a pipe stand, said collar rotatably mounted to a first end of a shaft, said arm having a first and a second end, said first end of said arm pivotably and rotatably mounted to a second end of said shaft;

a releasable pipe mount mounted to said second end of said arm, said releasable pipe mount engaging a predetermined portion of said pipe wherein said releasable pipe mount comprises:

a guide extending vertically in parallel to said pipe stand such that said guide engages a predetermined mid portion length of said mid-portion of said pipe stand to substantially prevent movement of said pipe stand engaging a mid-portion of said pipe stand; and a support member mounted to a first securing means attached to a lower end of said first securing means such that said support member receives said pipe stand to support the weight of said pipe stand and substantially prevent movement of said lower portion of said pipe stand;

wherein said first securing means and a second securing means provides support and stability to said pipe stand when said pipe stand engages said first securing means and said second securing means;

wherein said support member is configured to engage and mate with a tool joint on said pipe stand such that said support member supports the weight of said pipe stand and substantially prevents movement of said lower portion of said pipe stand, and a first actuator configured to elevate said first and said second secure means such that said pipe stand securely engaged to said first and said second securing means may be vertically raised for transport between the derrick and the pipe racking assembly, wherein when said first actuator elevates said first and said second securing means, said pipe stand slides vertically downwards until said tool joint engages and mates with said second securing means, wherein said arm is operable by a second actuator such that said arm displaces between a vertical position substantially parallel to said pipe stand and an angled position, wherein said arm displaces between said vertical position and said angled position such that said arm securely engages said guide and said second member to said pipe stand, wherein said arm further displaces between said vertical position and said angled position such that said arm transfers said pipe stand to the pipe racking assembly, wherein when said arm retracts to said vertical position after said guide and said support member securely engages said pipe stand, said collar receives said pipe stand in said gate opening such that said gate opening substantially prevents movement of said upper portion of said pipe stand, wherein said arm secures and transfers said pipe stand from the derrick to the pipe racking assembly, wherein a drive mechanism is mounted to said shaft, said drive mechanism for rotating said rotatable gate assembly between a pipe engaging position wherein said rotatable gate assembly is in operable communication with the derrick and a pipe racking position wherein said rotatable gate assembly is in operable communication with said pipe racking assembly.

2. An apparatus for handling pipe stands in a derrick over a well bore and racking the pipe stands substantially parallel to and offset from the well bore on a pipe racking assembly mounted on a pipe rack side of the derrick the apparatus comprising:

a gate assembly mounted to the pipe racking assembly so as to be offset from the well bore towards the pipe racking assembly, said gate assembly having a substantially U-shaped collar and an arm, said collar defining a gate opening to receive and secure an upper portion of a pipe stand, said collar rotatably mounted on said gate assembly and selectively rotatable thereon by selective actuation of a collar actuator, said collar selectively rotatable by said collar actuator between, and so as to expose said gate opening in a first position on, a derrick side of said gate assembly, and, so as to engage said gate opening in a second position, a rack-side of said gate assembly, said arm having a first and a second end, said first end of said arm pivotably and rotatably mounted on said gate assembly for simultaneous corresponding rotation with said rotation of said collar;

a releasable pine mount mounted to said second end of said arm, said releasable pipe mount releasably engaging a predetermined portion of said pine stand;

a support member mounted to said arm and configured to engage and mate with a tool joint on said pipe stand such that said support member supports the weight of said pipe stand and prevents movement of a lower portion of said pipe stand;

an arm actuator pivoting said arm between a retracted position substantially vertically aligned with said collar and first and second extended positions when said collar is in said first and second positions respectively and when in said first extended position said pipe mount engaging with and so as to hold said predetermined portion of said pipe stand when over said well bore, and wherein said second extended position racking the pipe stand held by said pipe mount in the pipe racking assembly; and wherein said arm secures and transfers said pipe stand from a position in the derrick in-line with the well bore to the pipe racking assembly by said collar receiving the pipe stand in said gate opening and, while the pipe stand remains in said gate opening, selectively rotating said collar between said first and second positions to thereby transfer the pipe stand through the pipe rack side of the derrick, a first actuator configured to elevate said pipe mount and said support member such that said pipe stand is vertically raised for transport between the derrick and the pipe racking assembly, wherein when said first actuator elevates said support member, said pipe stand slides vertically downwards until said tool joint engages and mates with said support member, wherein said arm is operable by a second actuator such that said arm displaces between a vertical position substantially parallel to said pipe stand and an angled position to securely engage said pipe mount to said pipe stand, wherein said arm displaces between said vertical position and said angled position such that said arm transfers said pipe stand securely engaged to said pipe mount to the pipe racking assembly, wherein when said arm retracts to said vertical position after said pipe mount securely engages said pipe stand, said gate opening adapted such that said gate opening substantially prevents movement of said upper portion of said pipe stand.

* * * * *